US007536833B2

(12) United States Patent
Baczuk et al.

(10) Patent No.: US 7,536,833 B2
(45) Date of Patent: May 26, 2009

(54) ONE-PIECE INJECTION MOLDED DOOR SILL ASSEMBLY

(75) Inventors: Eric A. Baczuk, Charlotte, NC (US); Matthew D. White, Charlotte, NC (US)

(73) Assignee: Masonite Corporation, Tampa, FL (US)

( * ) Notice: Subject to any disclaimer, the term of this patent is extended or adjusted under 35 U.S.C. 154(b) by 438 days.

(21) Appl. No.: 10/974,966

(22) Filed: Oct. 28, 2004

(65) Prior Publication Data

US 2006/0096190 A1 May 11, 2006

(51) Int. Cl.
*E06B 1/04* (2006.01)
*E06B 1/70* (2006.01)

(52) U.S. Cl. ..... 52/204.1; 49/467; 49/468; 49/469

(58) Field of Classification Search ..... 52/716.1, 52/212, 211, 213, 204.1; 49/467, 468, 469
See application file for complete search history.

(56) References Cited

U.S. PATENT DOCUMENTS 3,967,412 A * 7/1976 Governale ..... 49/468
4,945,680 A * 8/1990 Giguere ..... 49/468
5,283,977 A * 2/1994 Smith ..... 49/380
6,273,496 B1 * 8/2001 Guyomard et al. ..... 296/193.09
6,345,477 B1 * 2/2002 Kepler et al. ..... 52/204.1
6,352,779 B1 * 3/2002 Edwards et al. ..... 428/412
6,371,188 B1 * 4/2002 Baczuk et al. ..... 160/92
6,484,446 B2 * 11/2002 Young ..... 49/469
6,530,183 B1 * 3/2003 Kuei-Yung ..... 52/204.1
6,763,639 B2 * 7/2004 Bennett et al. ..... 52/212
6,789,358 B2 * 9/2004 Procton et al. ..... 49/471
7,266,929 B1 * 9/2007 Allred et al. ..... 52/211
2003/0106269 A1 * 6/2003 Bauman et al. ..... 49/467
2004/0139667 A1 * 7/2004 Massey et al. ..... 52/204.1
2005/0198911 A1 * 9/2005 Baczuk et al. ..... 49/504
2006/0053707 A1 * 3/2006 Palenske CI ..... 52/204.1
2006/0070707 A1 * 4/2006 Armstrong ..... 160/371

* cited by examiner

*Primary Examiner*—Richard E Chilcot, Jr.
*Assistant Examiner*—Ryan D Kwiecinski
(74) *Attorney, Agent, or Firm*—Berenato, White & Stavish, LLC

(57) ABSTRACT

A sill assembly includes an integral sill assembly having a sill base and an inclined threshold. The sill base is overmolded in an injection molding process onto the inclined threshold. A rail assembly is adjustably secured to the sill base.

14 Claims, 11 Drawing Sheets

ONE-PIECE INJECTION MOLDED DOOR SILL ASSEMBLY

BACKGROUND OF THE INVENTION

1. Field of the Invention

The present invention relates to threshold and door sill assemblies for use in door jam assemblies. In particular, the present invention relates to a molded door sill assembly having a threshold formed therewith.

2. Description of Related Art

Known threshold and door sill assemblies typically include multiple components such as a sill base, an inclined tread, and a threshold. These multiple components are typically constructed separately from one another and then secured to one another in a suitable manner to form the threshold and door sill assembly. Thus, known threshold and door sill assemblies are manufactured from several parts that require a highly structured assembly and installation process.

The present invention provides improvements over known threshold and door sill assemblies to simplify the manufacturing process, reduce the number of parts, and simplify the assembly and installation process. Furthermore, the present invention provides increased protection against moisture penetration and rot.

SUMMARY OF THE INVENTION

One aspect of the invention relates to a threshold and door sill assembly that includes a sill assembly formed by an injection molding process. This aspect of the invention provides a threshold and door sill assembly including a sill assembly having a sill base that is molded to an inclined threshold. The sill base is constructed of one material that is overmolded in an injection molding process onto the inclined threshold constructed of a second material to form an integral molded sill assembly. The sill assembly is configured to receive various sill components including but not limited to an adjustable rail assembly. The rail assembly is adjustably secured to the sill base.

Another aspect of the invention relates to a door sill assembly having a sill base, jamb supports, and an inclined threshold. This aspect of the invention provides a sill assembly for a door jamb assembly, wherein the door jamb assembly includes a pair of vertically extending jamb members, a header structure, and at least one door. The threshold and door sill assembly includes a molded sill assembly having a sill base and an inclined threshold. The sill base is constructed of one material that is overmolded in an injection molding process onto the inclined threshold constructed of a second material to form the molded integral sill assembly. The threshold was previously formed by, for example, an extrusion process. The threshold and door sill assembly can include a pair of jamb supports. One of the jamb supports is provided on one end of the sill base and the other of the jamb supports is provided on the opposite end of the sill base. The jamb supports protrude outwardly from the opposing ends of the sill base for engaging and supporting respective jamb members. The jamb supports provide a raised platform for the jamb members to protect against rot an moisture penetration. An adjustable rail assembly and other components are secured to the sill base.

Still another aspect of the invention relates to a method of forming a threshold and door sill assembly. This aspect of the invention provides a method of forming a threshold and door sill assembly for a door jamb assembly, wherein the door jamb assembly includes a pair of vertically extending jamb members, a header structure, and at least one door. The sill assembly includes a sill base that is injection molded around an inclined threshold, the sill base being constructed of one material that is overmolded in the injection molding process onto the inclined threshold constructed of a second material to form an integral sill assembly.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings:

FIG. 6 is an enlarged perspective view of the sill assembly shown in FIG. 2;

DETAILED DESCRIPTION OF ILLUSTRATED EMBODIMENTS

Figure 1:
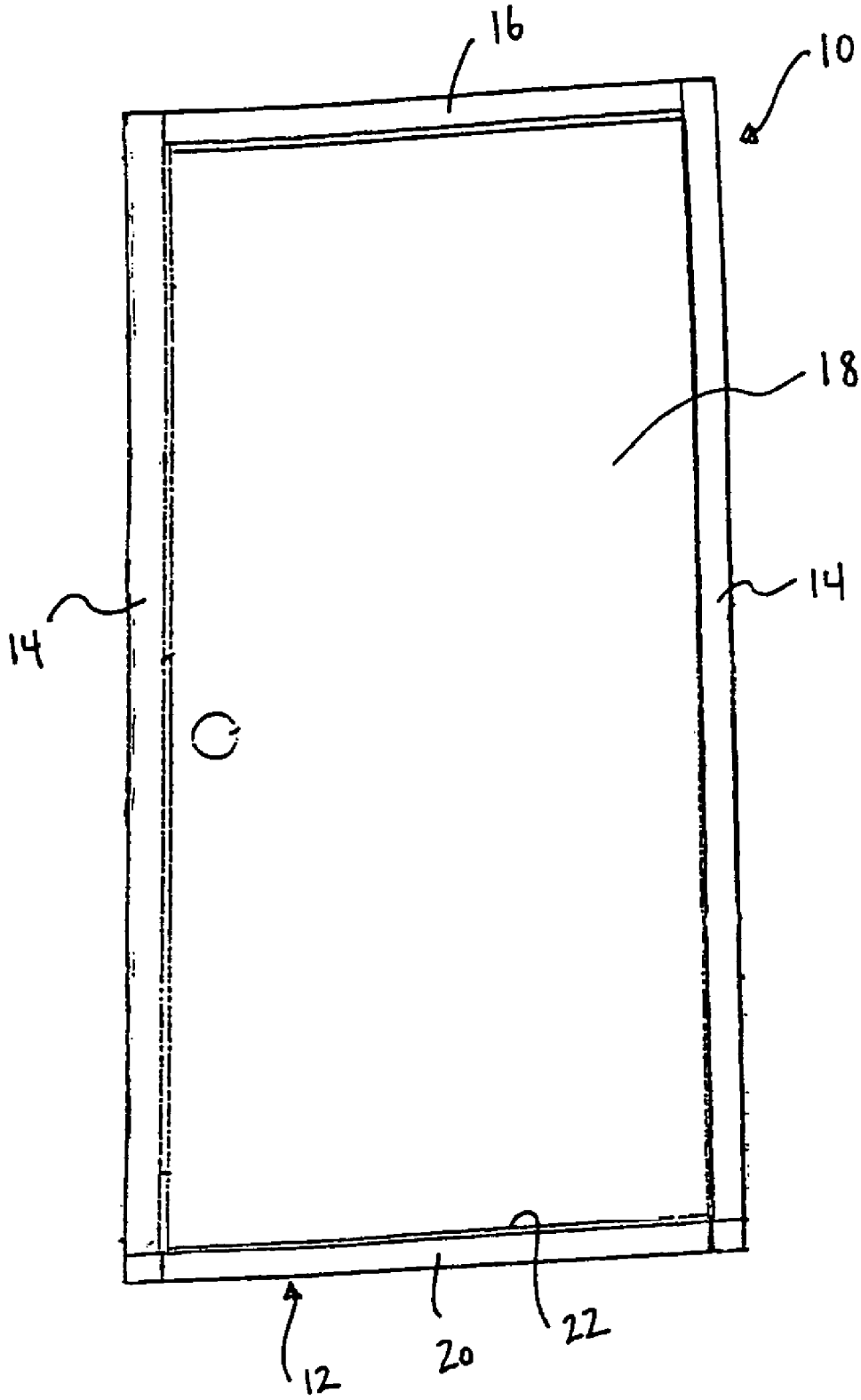
FIG. 1 is a front view of an embodiment of a door jamb assembly incorporating a sill assembly constructed in accordance with an embodiment of the invention.
Figures 2, 3, 4, 5:
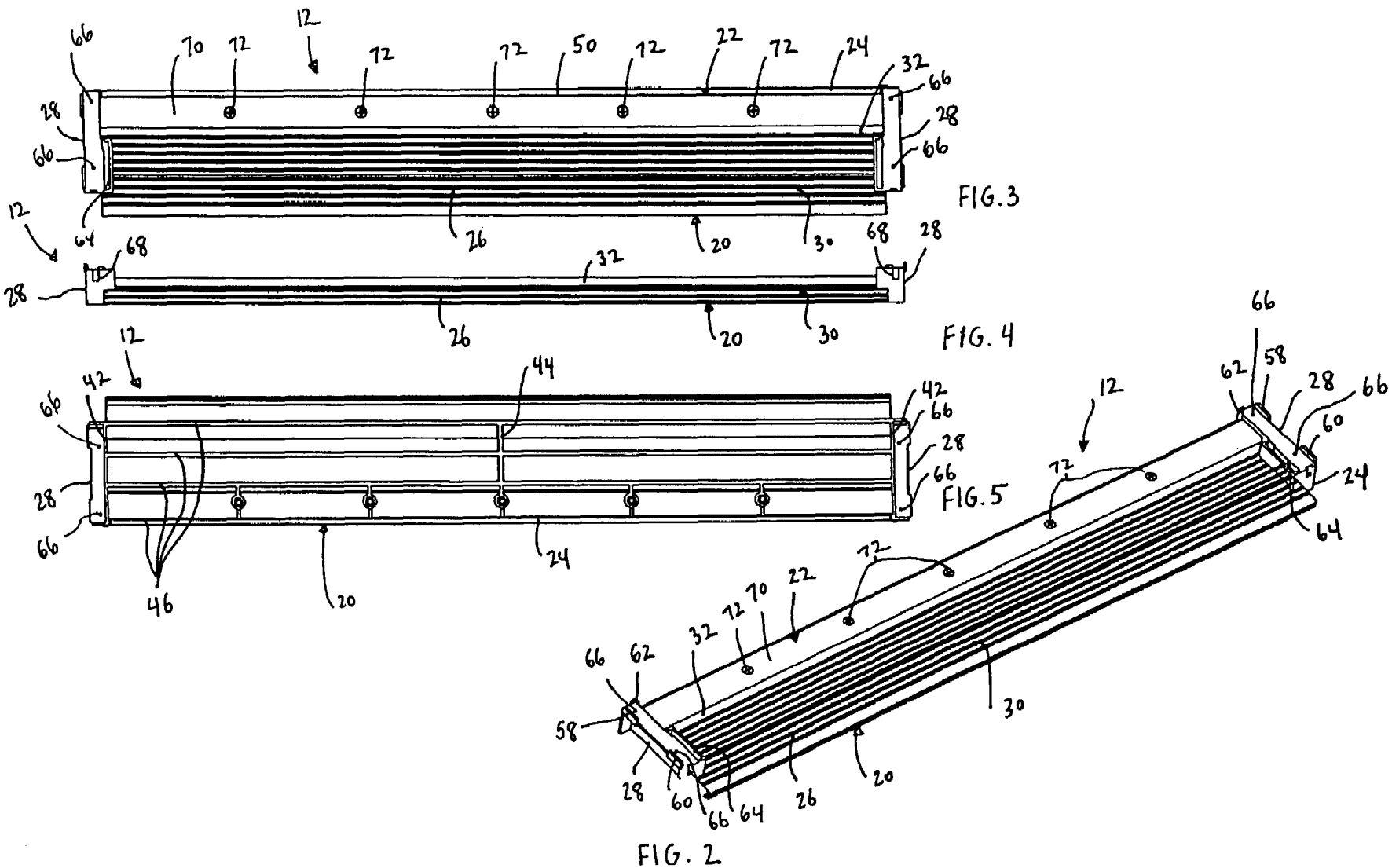
FIG. 2 is a perspective view of the threshold and door sill assembly constructed in accordance with an embodiment of the invention.
FIG. 3 is a top view of the sill assembly shown in FIG. 2.
FIG. 4 is a front view of the sill assembly shown in FIG. 2.
FIG. 5 is a bottom view of the sill assembly shown in FIG. 2.
Figure 9:
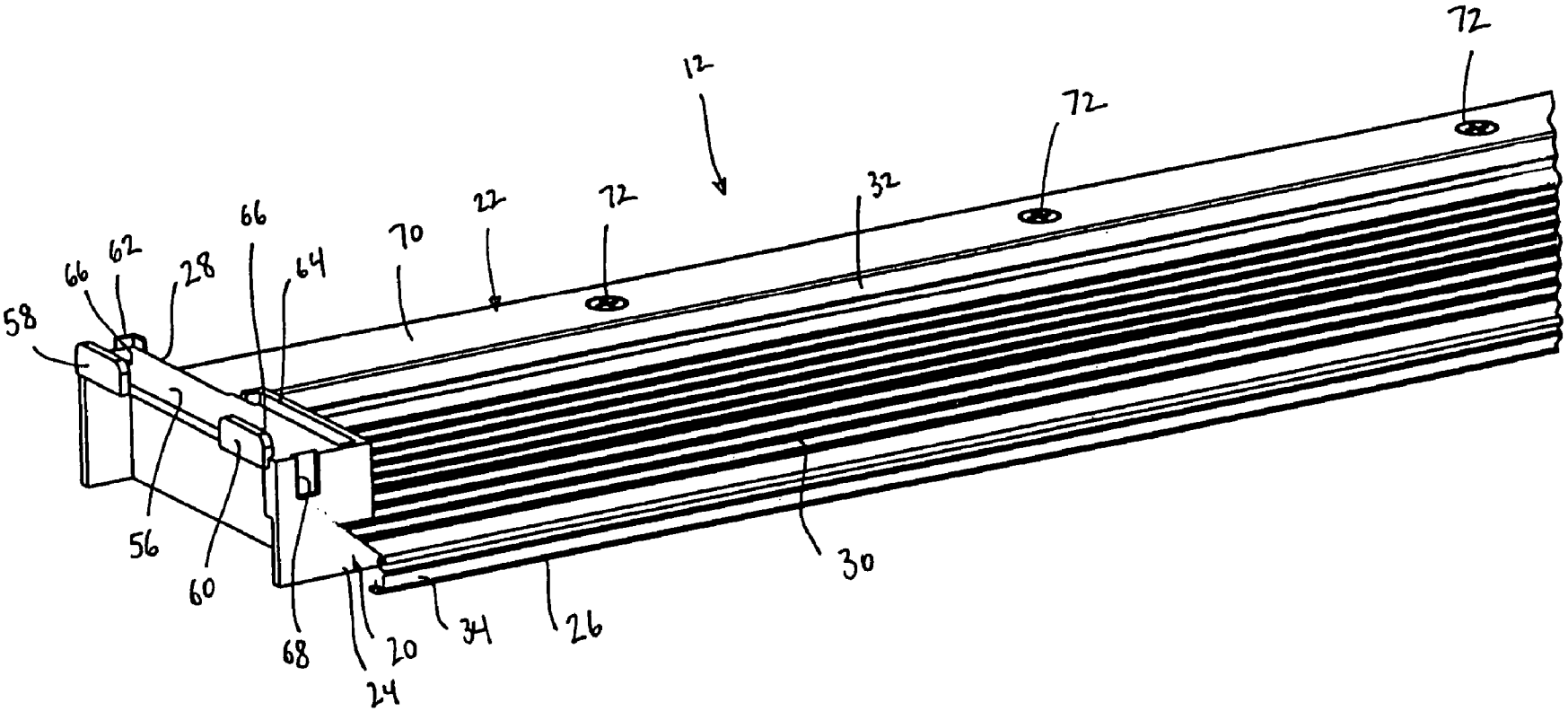
FIG. 9 is an end view of the sill assembly shown in FIG. 8.

FIG. 1 illustrates a door jamb assembly 10 incorporating a sill assembly 12 constructed according to an embodiment of the present invention. The door jamb assembly 10 includes a pair of vertically extending horizontally spaced jamb members 14, which are typically formed from wood, a horizontally extending header structure 16, which is also typically formed from wood, and at least one door 18. The sill assembly 12 includes an elongated sill assembly 20 that is connected at opposing ends to lower ends of the pair of vertically extending jamb members 14. The pair of jamb members 14, the header structure 16, and the sill assembly 12 form a generally rectangular door jamb opening within which the at least one door 18 is disposed.

The sill assembly 12 is not limited to use with the specific configuration of door jamb assembly shown and other various configurations are contemplated, for example, a door jamb assembly may include a pair of doors, sliding door panel, a combination of fixed and movable door panels and any combination of side panels including side panels disposed on one or both sides of the door. To accommodate the placement and support of side panels, the door jamb assembly may include one or more vertically extending mullions, which are connected at upper ends thereof to the header structure and at lower ends thereof to the threshold and door sill assembly 12 through a mullion boot assembly. Various arrangements and components are disclosed, for example, in U.S. patent application Ser. No. 10/673,639, entitled "Adjustable Rail Assembly And Components For The Same," the disclosure of which is incorporated herein specifically by reference.

In the illustrated embodiment, the sill assembly 12 includes a sill assembly 20 and a rail assembly 22 adjustably secured to the sill assembly 20. The sill assembly 20 is formed in one-piece by an injection molding process so as to simplify the manufacturing process, reduce the number of parts, and simplify the assembly and installation process.

As shown in FIGS. 2-6, the sill assembly 20 includes a sill base 24, and an inclined threshold 26. The sill assembly may also include a pair of jamb supports 28 (also referred to as corner keys). The jamb supports 28 can be integrally molded with the sill base 24 or formed as separate components. One of the jamb supports 28 is provided on one end of the sill base 24 and the other of the jamb supports 28 is provided on the opposite end of the sill base 24. The jamb supports 28 protrude outwardly from the sill base 24 for engaging and supporting respective jamb members 14. The jamb supports 28 or corner keys elevate the jamb members 14 above the sill assembly 20, which reduces moisture penetration and rot.

The inclined threshold 26 is overmolded with the sill base 24 by an injection molding process to provide a one-piece sill assembly 20. In the illustrated embodiment, the jamb supports 28 are formed in one-piece in the injection molding process along with the sill base 24 and the inclined threshold 26.

Figure 14:
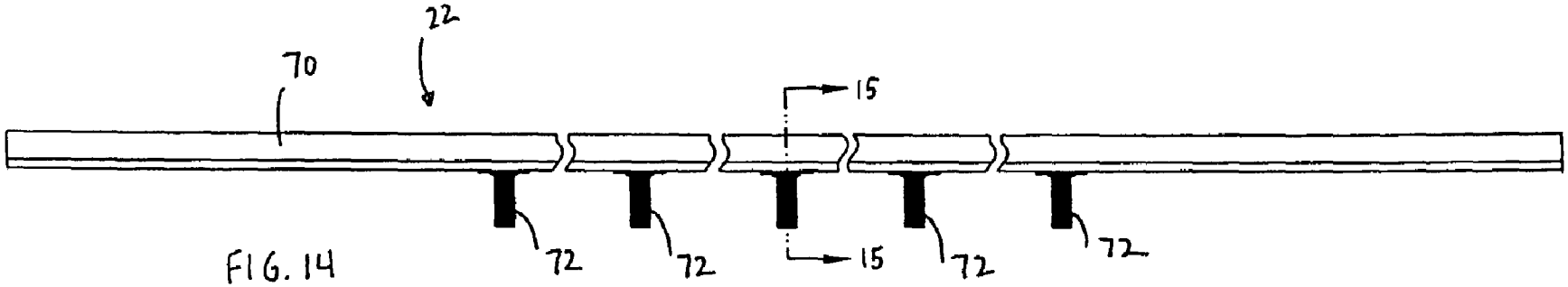
FIG. 14 is a side view of a rail assembly of the sill assembly shown in FIG. 2.
Figure 16:
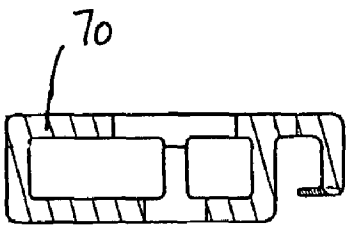
FIG. 16 is a cross-sectional view through line 15-15 of FIG. 14, with the fastener removed.
Figure 15:
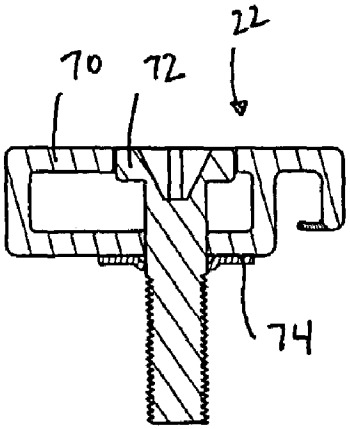
FIG. 15 is a cross-sectional view through line 15-15 of FIG. 14.

The rail assembly 22, shown in greater detail in FIGS. 14-16, is attached with fasteners to the sill assembly 20 through tapped holes 52 provided in the sill base 24. The tapped holes 52 are preferably formed in the sill base 24 during the injection molding process. Although it is also contemplated that the holes 52 may be formed in a separate machining operation.

Figure 7:
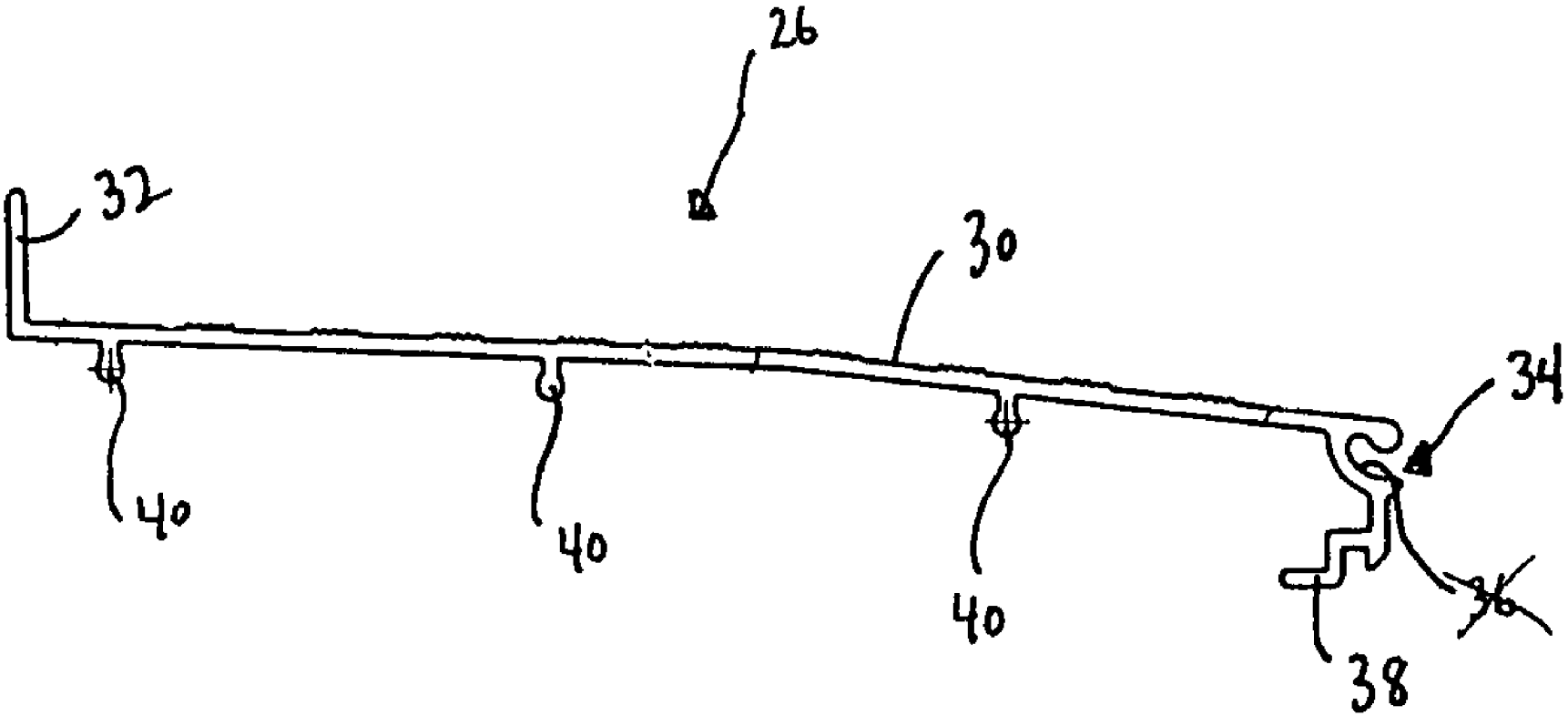
FIG. 7 is a side view of an inclined threshold of the sill assembly, shown in FIG. 2.
Figure 11:
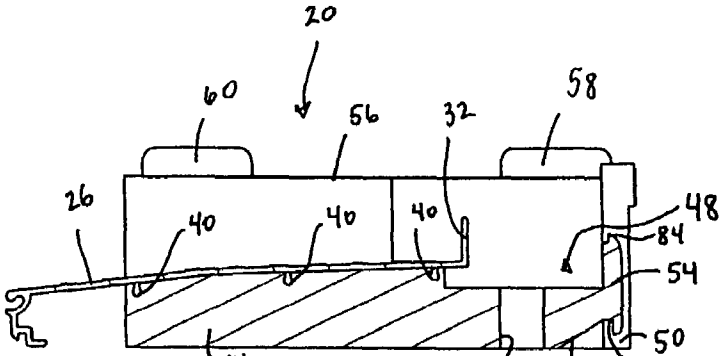
FIG. 11 is a cross-sectional view through line 11-11 of FIG. 8.

The one-piece injection molded sill assembly 20 will now be described in greater detail. As shown in FIG. 7, the inclined threshold 26 is preferably formed as a one-piece extrusion from aluminum or other suitable material. It is also contemplated that the threshold 26 may by formed from plastic or fiberglass. The threshold 26 includes an inclined top surface 30 that extends rearwardly from a forward edge to an upwardly extending lip structure 32. The upwardly extending lip structure 32 projects above the inclined top surface 30.

The inclined threshold 26 includes a leading edge portion 34 that extends downwardly from the forward edge thereof. The leading edge portion 34 provides a support member 38 that engages the floor in use to support the forward edge of the threshold 26. It is contemplated that the threshold 26 can be either a low threshold for a low profile sill assembly or a threshold for a high profile threshold sill assembly. Additionally, the threshold 26 can have an increased width to permit wheelchair use.

The threshold 26 includes a plurality of downwardly projecting extensions 40 (e.g., three extensions). The extensions 40 are provided to interconnect the threshold 26 with the sill base 24 during the overmolding process. The extensions 40 extend generally parallel to each other in the longitudinal direction. One or more extensions 40 are contemplated.

Figure 12:
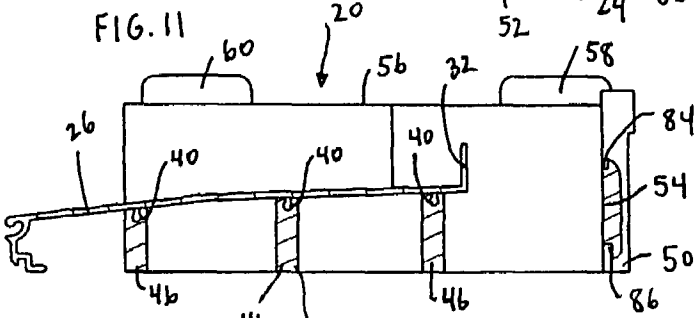
FIG. 12 is a cross-sectional view through line 12-12 of FIG. 8.
Figure 10:
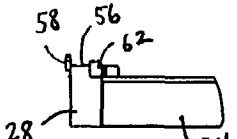
FIG. 10 is a rear view of the sill assembly shown in FIG. 8 adjacent one end of the sill assembly.
Figure 8:
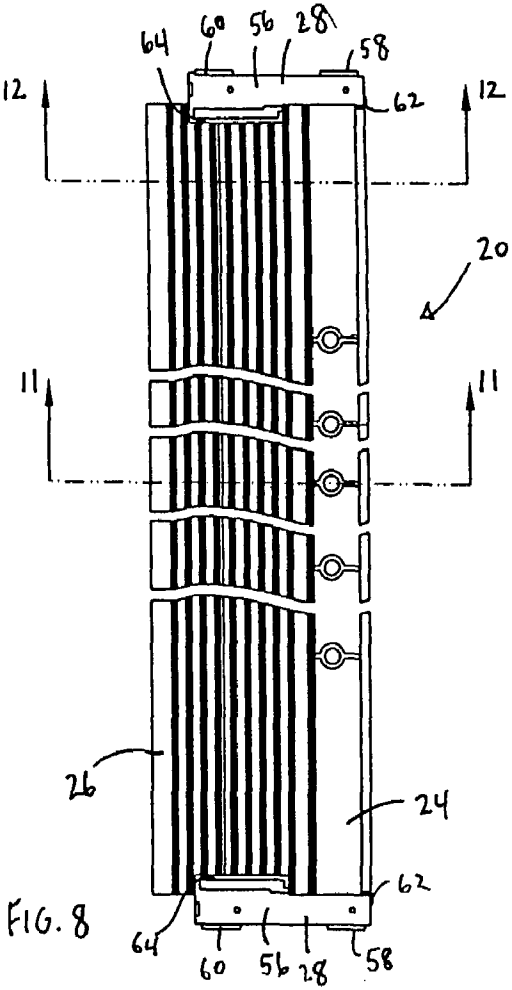
FIG. 8 is a top view of the sill assembly shown in FIG. 2, wherein the adjustable rail assembly is removed to illustrate the rail assembly mounting structure.
Figure 9:
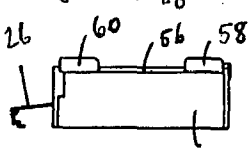
Figure 13:
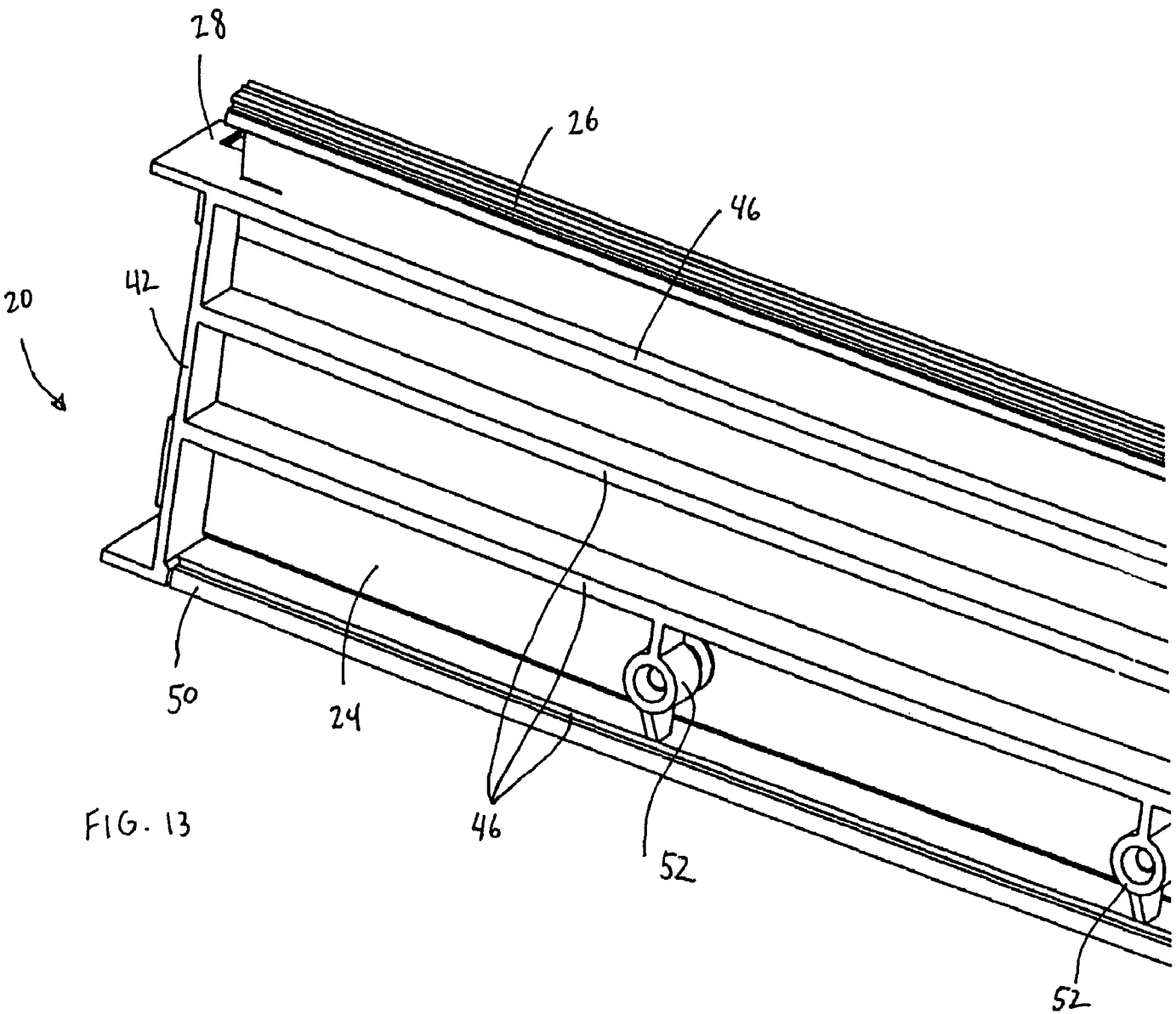
FIG. 13 is an enlarged bottom perspective view of the sill assembly shown in FIG. 2.

As shown in FIGS. 5 and 8-13, the sill base 24 extends the length of the sill assembly 20. As best shown in FIGS. 5, 11, 12, and 13, the sill base 24 includes end walls 42, at least one intermediate wall 44, and a plurality of transverse reinforcing walls 46 that increase the over all strength and stability of the sill base 24. Moreover, when the sill base 24 is overmolded onto the threshold 26, the reinforcing walls 46 are overmolded or interconnected with a corresponding extension 40 provided on the threshold 26 (see FIG. 12). Thus, the spacing between reinforcing walls 46 corresponds with the spacing between extensions 40 on the threshold 26. As shown in FIG. 12, for example, the end walls 42 and intermediate wall 44 are also interconnected with the extensions 40, which increase the stability and strength of the sill assembly 20.

The sill base 24 is preferably formed of a non-rot synthetic material, e.g., polymeric or composite material. Thus, the sill base 24 is constructed of one material, e.g., synthetic, that is overmolded onto the threshold 26 that is constructed of a second material, e.g., aluminum, to form the one-piece sill assembly 20. However, it is contemplated that the sill base 24 and threshold 26 may be formed of similar materials and molded as a single unit. With such an arrangement, the number of walls 44 and 46 may be increased to improve the rigidity of the sill assembly.

The lip structure 32 of the threshold 26 forms one side of a channel 48 that extends along the length of the sill base 24. An opposite side of the channel 48 is formed from an upwardly extending rear portion 50 provided on the sill base 24. A plurality of tapped holes 52 are provided in the channel 48 of the sill base 24 for securing the rail assembly 22. The tapped holes 52 may be formed in the sill base 24 during the injection molding process or may be formed in a separate machining operation. Also, the upwardly extending rear portion 50 has an attachment structure 54 formed thereon for securing a trim piece 76, as will be further discussed below.

In the illustrated embodiment, the vertically extending jamb members 14 are connected to the sill assembly 20 by directly securing the vertically extending jamb members 14 to the jamb supports 28 provided on the sill assembly 20. As best shown in FIGS. 6 and 9-12, each jamb support 28 or corner key includes a substantially flat jamb support surface 56 that forms a base upon which the corresponding vertically extending jamb member 14 rests. The jamb supports 28 raise the jamb members 14 above the top surface 30 of the threshold 26 such that it is not in contact with any water that is standing or draining off the top surface 30. This arrangement reduces exposure of the end grain of the jamb members 14 to moisture and enhances rot prevention. The jam supports 28 also minimize damage to the bottom of the jamb members 14 during transportation. A seal assembly, e.g., gasket, may be located between the support surface 56 and corresponding jamb member 14.

The jamb support surface 56 includes a plurality of upwardly extending support flanges that are structured to engage the corresponding jamb member 14 and prevent lateral movement of the same on the jamb support 28. As best shown in FIGS. 6 and 8-10, a first rib 58 extends upwardly from an edge of the support surface 56 and a second rib 60 is laterally spaced from the first rib 58 along the edge. Opposite the first rib 58 is a corner rib 62 that extends upwardly from adjacent edges. An opening 64 is provided in the portion of the jamb supports 28 that extends over the top surface 30 to permit drainage of any water that might collect on the surface 56. This moisture then drains down the top surface 30.

The jamb supports 28 are secured to respective jamb members 14 by a plurality of fasteners. In the illustrated embodiment, a pair of openings 66 (see FIGS. 2, 3, and 5) are provided through the support surface 56 that allow fasteners to extend therethrough and into the respective jamb member 14.

The jamb supports 28 also have an interlocking structure 68 formed therewith that allows the jam supports 28 to interlock with a jam support extension 88, as will be further discussed.

An advantage of the integral jamb supports 28 is that they eliminate a critical machining operation. That is, the jamb members 14 only need a square cut on the bottom thereof in order to accommodate the jamb supports 28. This simplifies modifications for shorter doors and improves quality control.

In the illustrated embodiment, the sill base 24 and jamb supports 28 are preferably formed of a synthetic material. It is noted that a synthetic material is preferable, since this type of material is generally resistant to decay or other degradation. For example, water cannot travel up the jamb supports 28 and into the jamb members 14 to cause rot.

FIGS. 14-16 illustrate the rail assembly 22. The rail assembly 22 is secured to the sill assembly 20 to close or eliminate any gap between the sill assembly 20 and the bottom of the door 18. The height of the rail assembly 22 may be adjusted to ensure a good seal with the sweep on the bottom of the door 18.

As shown in FIGS. 14-16, rail assembly 22 includes a rail member 70 and a plurality of adjustment bolts 72 and associated washers 74. The rail member 70 is preferably formed from an extruded plastic material, e.g., PVC. The rail member is 70 adapted to be received within the channel 48 of the sill base 24 such that an upper portion of the rail member 70 extends past or adjacent to the lip structure 32 and the upwardly extending portion 50 of the sill base 24. The adjustment bolts 72 secure the rail member 70 to the sill base 24. Specifically, the adjustment bolts 72 are received within a corresponding tapped hole 52 provided within the channel 48 of the sill base 24. Rotation of the bolts 72 with respect to the sill base 24 can raise and lower the rail member 70 with respect to the sill assembly 20. The rail assembly 22 is capable of vertical but not lateral movement.

Figure 17:
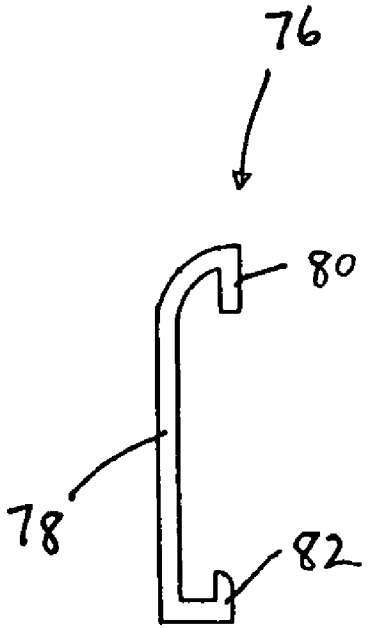
FIG. 17 is a side view of a rear trim piece for the sill assembly shown in FIG. 2.
Figure 18:
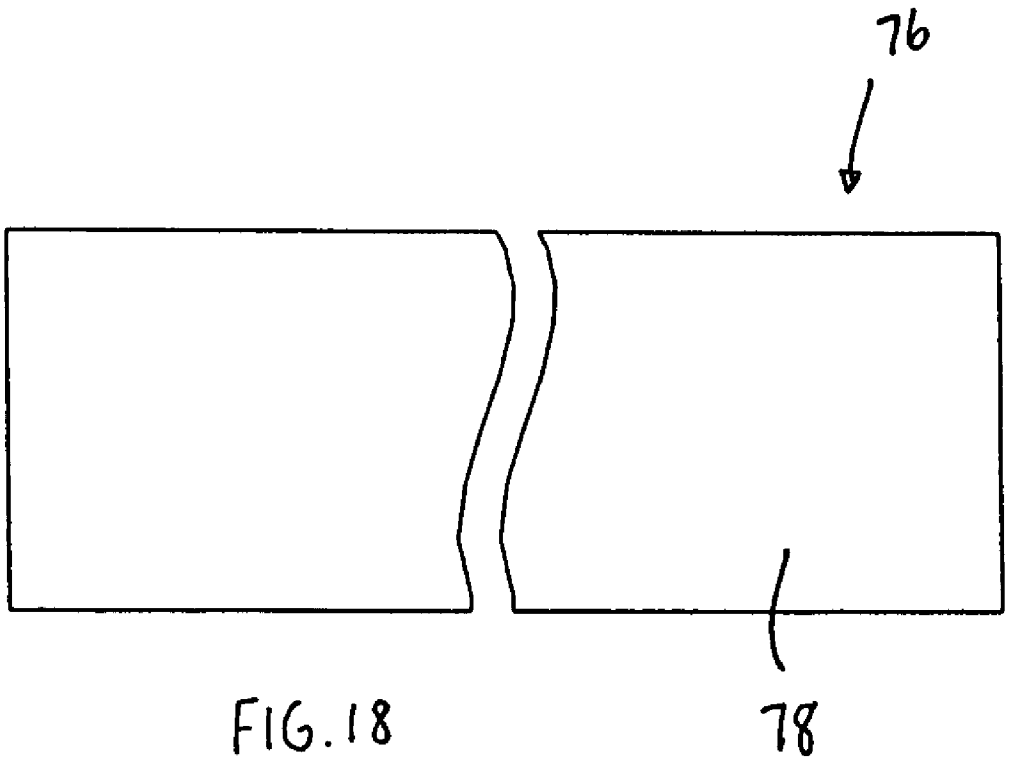
FIG. 18 is a rear view of the trim piece shown in FIG. 17.

FIGS. 17 and 18 illustrated a contoured trim piece 76 that may be fastened to a rear end portion of the sill assembly 20 to cover the rear side of the channel 48 and for aesthetics. The trim piece 76 has an exposed surface 78 that faces the interior of the building. In the illustrated embodiment, the trim piece 76 is fastened to the sill assembly 20 with a snap-fit. Specifically, the trim piece 76 has upper and lower hook portions 80, 82. As noted above, the upwardly extending portion 50 of the sill base 24 has an attachment structure 54 with upper and lower recessed portions 84, 86 (see FIGS. 11 and 12). The lower hook portion 82 of the trim piece 76 is first engaged with the lower recessed portion 86 of the attachment structure 54, and then the upper hook portion 80 is engaged with a snap-fit with the upper recessed portion 84 to secure the trim piece 76 to the attachment structure 54. However, the trim piece 76 may be secured to the sill base 24 in any other suitable manner.

Figure 19:
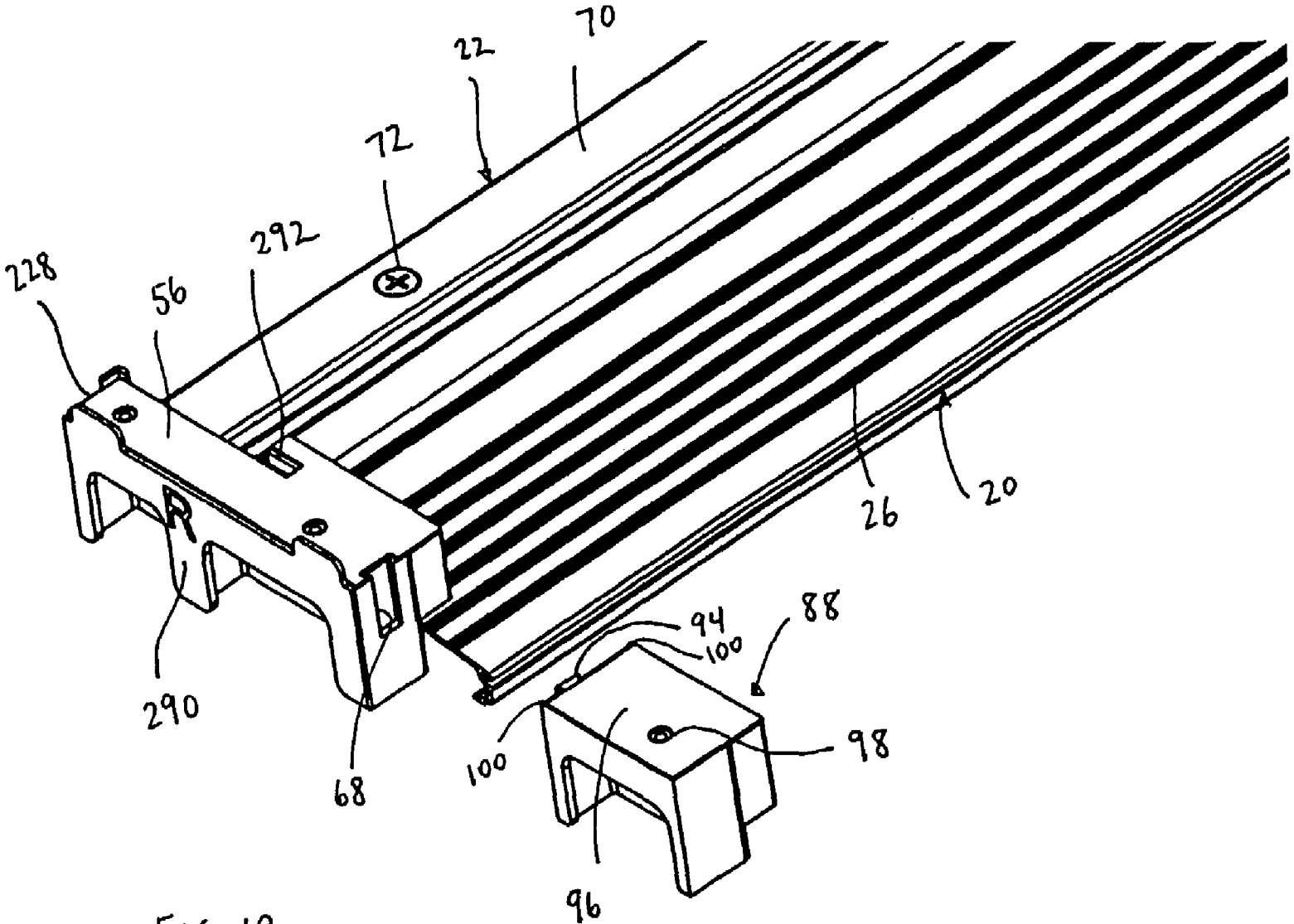
FIG. 19 is a perspective view of a jam support extension aligned with an associated jam support for use on a molded sill assembly having an extended threshold.
Figure 20:
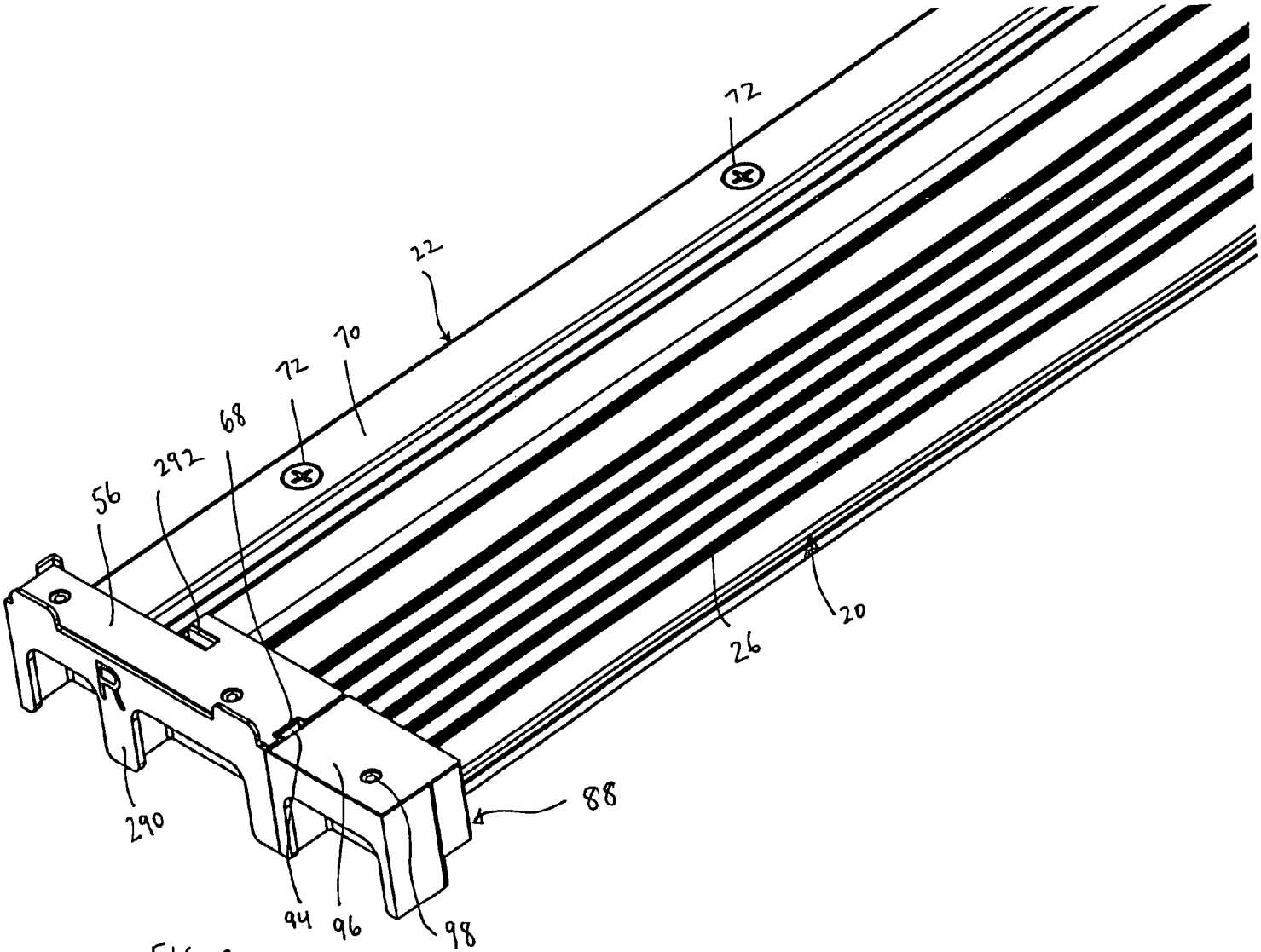
FIG. 20 is a perspective view of a jam support extension of FIG. 19 connected to the associated jam support.

FIGS. 19 and 20 illustrate a jamb support extension 88 that may be connected with an associated jamb support 28. FIGS. 19 and 20 illustrate another embodiment of a jamb support 228. However, it should be understood that the jamb support extension 88 may be utilized with either jamb support 28, 228 in a similar manner. The jamb support 228 is substantially similar to the jamb support 28 described above and is indicated with similar reference numerals. In contrast, the jamb support 228 does not include the opening 64 and the jamb support 228 has a different outer side wall structure 290. Additionally, the jamb support 228 includes a 292 notch for accepting a weatherstrip therein.

As noted above, the jamb supports 28, 228 have an interlocking structure 68, in the form of a recess, formed therewith. The jamb support extension 88 has an interlocking structure 94, in the form of an extension, formed therewith. In use, the extension of the jamb support extension 88 is inserted into the recess of the jamb support 28, 228 to interlock the jamb support extension 88 with the jamb support 28, 228 in cooperating relation. The jamb support extension 88 allows the sill assembly 20 to accommodate wider door jambs 14 and/or wider thresholds 26. Accordingly, the jamb support extension 88 includes a substantially flat jamb support surface 96 that is flush with the support surface 56 in use. The jamb support extension 88 also includes an openings 98 that allows a fastener to extend therethrough and into the respective jamb member 14. Additionally, the jamb support extension 88 includes seal members 100 that overlap the jamb support 28, 228 in use to seal the edges between the jamb support extension 88 and the jam support 28, 228. The jamb support extension 88 may be formed with a similar material and by a similar process, e.g., molding, as the jamb supports 28, 228.

In the illustrated embodiment, the sill assembly 20 has a high profile. However, the sill assembly 20 may be suitably modified to provide a low profile wherein the overall height is lower than that of the high profile sill assembly.

Figure 21:
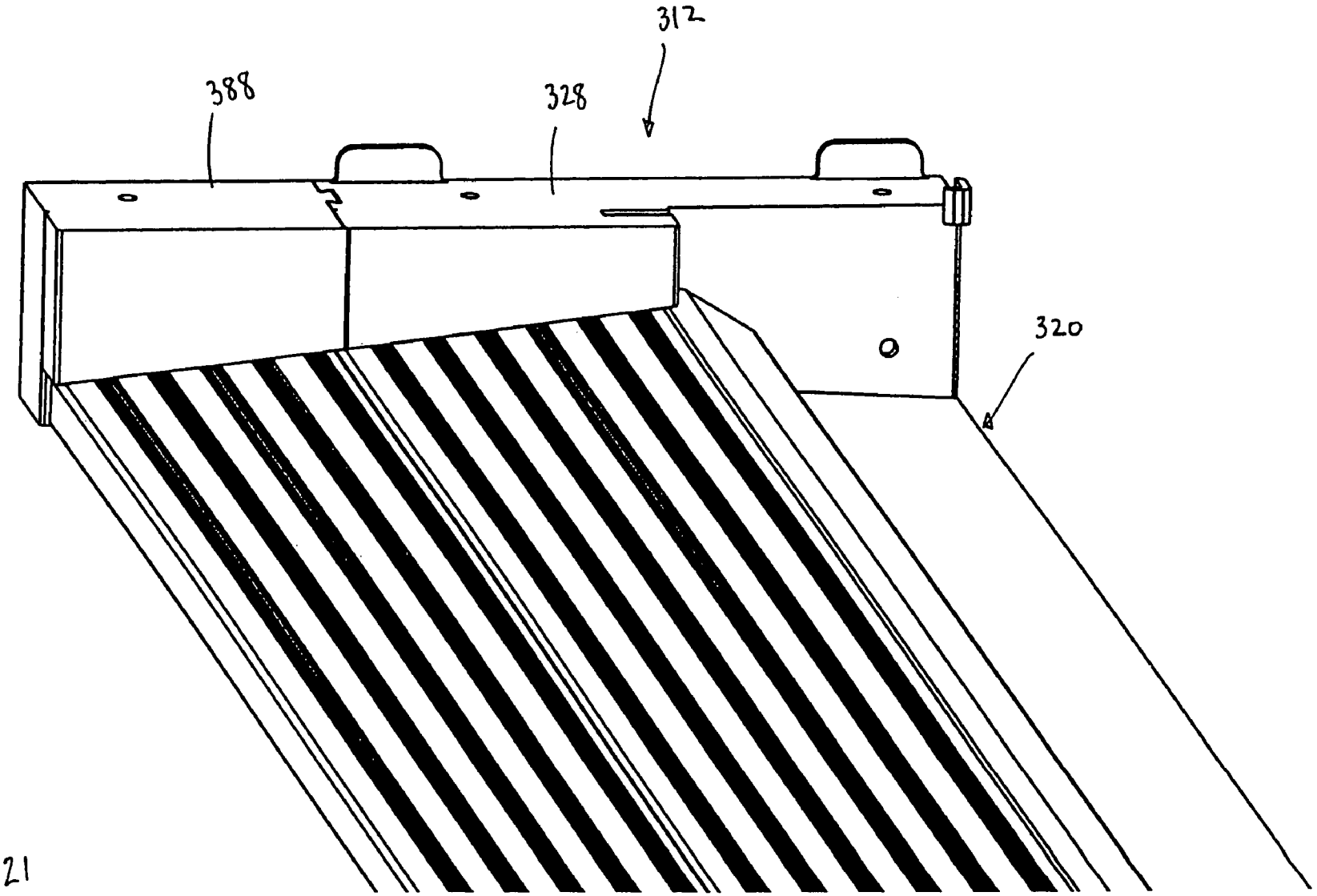
FIG. 21 is another embodiment of a door sill assembly.

FIG. 21 illustrates another embodiment of a threshold and door sill assembly 312 having a one-piece sill assembly 320. As illustrated, jamb support extensions 388 are connected to respective jamb supports 328 of the sill assembly 320. Additionally, the rear end of the sill assembly 320 is structured to accommodate a wide range of doors, including for example sliding doors.

It can thus be appreciated that the aspects of the present invention have been fully and effectively accomplished. The foregoing specific embodiments have been provided to illustrate the structural and functional principles of the present invention, and are not intended to be limiting. To the contrary, the present invention is intended to encompass all modifications, alterations, and substitutions within the spirit and scope of the appended claims.

What is claimed is:

1. A sill assembly comprising:

a sill base;

an inclined threshold supported by said sill base, said threshold having a bottom with oppositely disposed ends and a plurality of extension ribs extending from said bottom intermediate said ends, and said sill base being molded with said extension ribs for thereby forming an integral structure;

a rail assembly secured to said sill base;

a pair of jamb supports, one of the jamb supports being provided on one end of the sill base and the other of the jamb supports being provided on the opposite end of the sill base, the jamb supports protruding outwardly from the sill base for engaging and supporting respective jamb members of a door jamb assembly; and a pair of jamb support extensions that are interlocked with a respective one of the jamb supports, the jamb support extensions allowing the sill assembly to accommodate at least one of wider door jamb members and wider thresholds.

2. The sill assembly according to claim 1, wherein the threshold includes an upwardly extending lip structure and the sill base includes an upwardly extending portion, the upwardly extending lip structure and the upwardly extending portion forming a channel adapted to receive the rail assembly.

3. The sill assembly according to claim 2, wherein the channel includes a plurality of holes for securing the rail assembly.

4. The sill assembly according to claim 3, wherein the plurality of holes are formed in the sill base during the injection molding process.

5. The sill assembly according to claim 1, wherein the jamb supports are formed in one-piece in the injection molding process along with the sill assembly.

6. The sill assembly of claim 1, wherein distal ends of the extension ribs have cross sectional shapes that are larger than cross sectional lengths of the extension ribs.

7. The sill assembly of claim 1, wherein said extension ribs extend along a lengthwise direction of said inclined threshold.

8. The sill assembly of claim 1, wherein said sill base is integrally overmolded on said extension ribs.

9. A door sill assembly for a door jamb assembly, wherein the door jamb assembly includes a pair of vertically extending jamb members, a header structure, and at least one door, the sill assembly comprising:

a sill base;

an inclined threshold supported by said sill base, said threshold having a bottom with oppositely disposed ends and a plurality of extension ribs extending from said bottom intermediate said ends, and said sill base being molded with said extension ribs;

a pair of jamb supports, one of said jamb supports being provided on one end of said sill base and the other of said jamb supports being provided on the opposite end of said sill base, wherein said jamb supports protrude outwardly from said sill base for engaging and supporting a respective one of said jamb members;

a rail assembly secured to said sill base; and a pair of jamb support extensions that are interlocked with a respective one of the jamb supports, the jamb support extensions allowing the sill assembly to accommodate at least one of wider door jamb members and wider thresholds.

10. The sill assembly according to claim 9, wherein the threshold includes an upwardly extending lip structure and the sill base includes an upwardly extending portion, the upwardly extending lip structure and the upwardly extending portion forming a channel adapted to receive the rail assembly.

11. The sill assembly according to claim 10, wherein the channel includes a plurality of holes for securing the rail assembly.

12. The sill assembly according to claim 11, wherein the plurality of holes are formed in the sill base during the injection molding process.

13. The sill assembly according to claim 9, wherein the jamb supports are formed in one-piece in the injection molding process along with the sill assembly.

14. A sill assembly comprising:

a sill base;

an inclined threshold integrally supported by said sill base;

a rail assembly secured to said sill base;

a pair of jamb supports, one of said jamb supports being provided on one end of said sill base and the other of said jamb supports being provided on the opposite end of said sill base, wherein said jamb supports protrude outwardly from said sill base for engaging and supporting respective jamb members of a door jamb assembly; and a pair of jamb support extensions that are removably interlocked with a respective one of said jamb supports, said jamb support extensions allowing said sill assembly to accommodate at least one of wider door jamb members and wider thresholds.

* * * * *